US010571232B1

(12) United States Patent
Hoffman

(10) Patent No.: US 10,571,232 B1
(45) Date of Patent: Feb. 25, 2020

(54) COMPRESSIBLE CARTRIDGE CASE

(71) Applicant: US. Government as Represented by the Secretary of the Army, Picatinny Arsenal, Dover, NJ (US)

(72) Inventor: Brian R. Hoffman, Bangor, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/127,474

(22) Filed: Sep. 11, 2018

Related U.S. Application Data

(60) Provisional application No. 62/632,497, filed on Feb. 20, 2018.

(51) Int. Cl.
*F42B 5/34* (2006.01)
*F42B 30/02* (2006.01)
*F42B 33/00* (2006.01)

(52) U.S. Cl.
CPC ..... *F42B 5/34* (2013.01); *F42B 30/02* (2013.01); *F42B 33/00* (2013.01)

(58) Field of Classification Search
CPC ..... F42B 5/34; F42B 30/02; F42B 33/00
USPC ..... 102/430, 432, 433, 464, 465–496; 89/19.5, 19.6, 19.7
See application file for complete search history.

(56) References Cited

U.S. PATENT DOCUMENTS

| | | | | |
|---|---|---|---|---|
| 1,376,530 | A | 5/1921 | Harry | |
| 1,470,591 | A * | 10/1923 | Behar | F42B 5/073 102/430 |
| 2,846,926 | A * | 8/1958 | Kimball | F41A 3/54 89/196 |
| 3,209,691 | A | 10/1965 | Herter | |
| 3,935,816 | A | 2/1976 | Boquette | |
| 4,726,296 | A | 2/1988 | Leshner | |
| 6,860,207 | B1 * | 3/2005 | Robertson | F42B 7/12 102/430 |
| 8,408,137 | B2 | 4/2013 | Battaglia | |
| 8,443,730 | B2 | 5/2013 | Padgett | |
| 8,738,330 | B1 * | 5/2014 | DiMartino | F42B 12/365 102/202 |
| 8,869,702 | B2 | 10/2014 | Padgett | |
| 2005/0115445 | A1 * | 6/2005 | Reynolds | F42B 5/045 102/469 |

FOREIGN PATENT DOCUMENTS

| | | | | |
|---|---|---|---|---|
| DE | 1133280 B | * | 7/1962 | F42B 5/34 |

* cited by examiner

*Primary Examiner* — John Cooper
(74) *Attorney, Agent, or Firm* — John P. DiScade

(57) ABSTRACT

A cartridge case with a case crush region that facilitates an additional amount of case crush in the axial direction, per unit of input force and energy, as compared to an identical cartridge case without such a region. The crush region may conceivably be either of a fully or partially circumferential nature with applicability to any style cartridge case, be it bottleneck or straight-walled and of any rim configuration (rimmed, semi-rimmed, rimless, rebated-rim, belted) and without prejudice to the case material (brass, stainless steel, polymer, etc.). This feature may be incorporated into the design of existing cartridge cases as well as future designs.

13 Claims, 5 Drawing Sheets

COMPRESSIBLE CARTRIDGE CASE

CROSS-REFERENCE TO RELATED APPLICATIONS

This application claims the benefit under 35 USC § 119(e) of U.S. provisional patent application 62/632,497 filed on Feb. 20, 2018.

STATEMENT OF GOVERNMENT INTEREST

The inventions described herein may be manufactured, used and licensed by or for the United States Government.

BACKGROUND OF THE INVENTION

The invention relates in general to firearms and more specifically to ammunition for firearms.

A significant and longstanding deficiency inherent to ammunition cartridge case designs is that they allow for only a very small amount of case crush during locking of the firearm bolt for a given amount of input force and energy. This deficiency is widespread in both military and commercial applications and affects conventional as well as developmental cartridge designs independent of particular case material.

Headspace is a fundamentally important characteristic to both the firearm and ammunition designer and is the distance from the feature in the cartridge chamber that limits forward movement of the cartridge to the feature in the firearm locking mechanism that limits rearward movement of the cartridge. In the vast majority of firearms, the cartridge chamber is an integral part of the gun barrel, and the bolt face is the feature in the firearm locking mechanism that limits rearward movement of the cartridge. In production firearms, headspace is not a singular value but rather a defined range of acceptable values to allow for component level manufacturing tolerances and/or assembly tolerances. In addition to allowable headspace tolerance, the cartridge case itself also has a manufacturing tolerances to include acceptable deviations in the portion of its length that interacts with the headspace controlling features of the firearm mechanism as previously described.

Prior Art FIG. 1 shows a conventional cartridge with a bottleneck configuration. Prior Art FIG. 2 shows a cross-sectional view of a conventional cartridge with a bottleneck configuration. The cartridge comprises a conventional cartridge case, a primer, an interior volume for propellant and a projectile.

For example, consider a bottleneck cartridge in caliber .308 Winchester, which is a close commercial equivalent to the popular military 7.62×51 mm NATO caliber. Per the Sporting Arms and Ammunition Manufacturers' Institute (SAAMI), recommended chamber headspace and case length limits are defined in publication ANSI/SAAMI Z299.4-2015, which is hereby incorporated by reference. The recommended range of chamber headspace values for this particular caliber are 1.630-1.640 inches. The recommended range of values of the portion of the cartridge case length that interfaces with the chamber headspace controlling features are 1.634-0.007 inches, or 1.627-1.634 inches. If chamber headspace is at its minimum value of 1.630 inches and cartridge case length is at its maximum value of 1.634 inches, there will be an interference condition of 1.630-1.634 or −0.004 inch between the cartridge case head and the bolt face when the cartridge is fully chambered and the bolt is locked. If chamber headspace is at its maximum value of 1.640 inches and cartridge case length is at its minimum value of 1.627 inches, there will be a clearance condition of 1.640-1.627 or 0.013 inch between the cartridge case head and the bolt face when the cartridge is fully chambered and the bolt is locked.

In the minimum chamber and maximum case scenario, the resulting interference in the axial direction is referred to as case crush. As its name implies and in order to fully lock, the firearm locking mechanism must deform/crush the chambered cartridge case by an amount equal to the interference. In terms of practical implementation, ease of use, and maintaining reliable function, the maximum amount of case crush imposed by the firearm designer, by way of chamber headspace definition, is limited by the required amount of input force and energy to crush the case. For manually operated firearms (bolt action rifle, for example), if too much case crush were imposed, the operator may not be able to lock the bolt as the force required to do so may exceed what is achievable by a person of typical stature and strength. For self-powered, auto cycling firearms (open bolt fired machine gun, for example), excessive case crush demands may require an amount of energy that exceeds the percentage of firearm operating group counter recoil energy available for this specific event resulting in either the locking mechanism being unable to fully lock or, if able to fully lock, reducing the firing pin impact velocity and/or impact energy to the point of inducing cartridge misfires.

In the maximum chamber and minimum case scenario, clearance in the axial direction exists between the locked bolt face and chambered cartridge case head. The amount of possible clearance is effectively limited by the material properties of the cartridge case and its ability to accommodate deformation without structural compromise or failure. From a producibility perspective in terms of reducing manufacturing costs, it is preferable to impose chamber headspace limits that allow for the maximum amount of clearance as this translates into larger tolerances for the manufacture and assembly of the firearm components that contribute to chamber headspace. The downsides to increasing clearance, however, are in accepting a decreased level of position control of the chambered cartridge as well additional structural demands on the bolt locking features due to the impulsive impact load applied by the case head to the bolt face during firing. Decreased position control of the chambered cartridge leads to inconsistencies in the initial launch angle of the bullet as it departs the case, which subsequently contributes to degraded downrange accuracy and precision. As for the impact loading of the case head onto the bolt face during firing, this phenomena is often addressed by the firearm designer by applying a load/scale factor to the combined stress calculations governing the bolt features that structurally support the firing event. An impact load factor is applied to the pressure induced stresses in order to ensure survivability and/or acceptable fatigue life. If the firing forces were not of an impactful nature, bolt life would immediately increase (without any design changes), or the bolt could be redesigned to a smaller/lighter version (while maintaining same life expectations of existing bolt).

In summary, cartridge case designs inherently only allow for a very small amount of case crush to take place during locking of the firearm bolt, which subsequently leads to allowable clearance between the bolt face and cartridge case head when firing production ammunition. This has three unique and significant consequences. The first is degraded firing accuracy and precision. The second is that increased structural demands are placed on the locking features of the bolt, which leads to decreased life or larger/heavier designs.

The third is that it limits the allowable manufacturing and assembly tolerances for components influencing chamber headspace, which increases cost.

A need exists for a cartridge case which allows for a more substantial amount of case crush to take place during the locking of the firearm bolt.

SUMMARY OF INVENTION

A cartridge case with a case crush region facilitates an additional amount of case crush in the axial direction, per unit of input force and energy, as compared to an identical cartridge case without such a region. The crush region may conceivably be either of a fully or partially circumferential nature with applicability to any style cartridge case, be it bottleneck or straight-walled and of any rim configuration (rimmed, semi-rimmed, rimless, rebated-rim, belted) and without prejudice to the case material (brass, stainless steel, polymer, etc.). This feature may be incorporated into the design of existing cartridge cases as well as future designs.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

Figure 1:
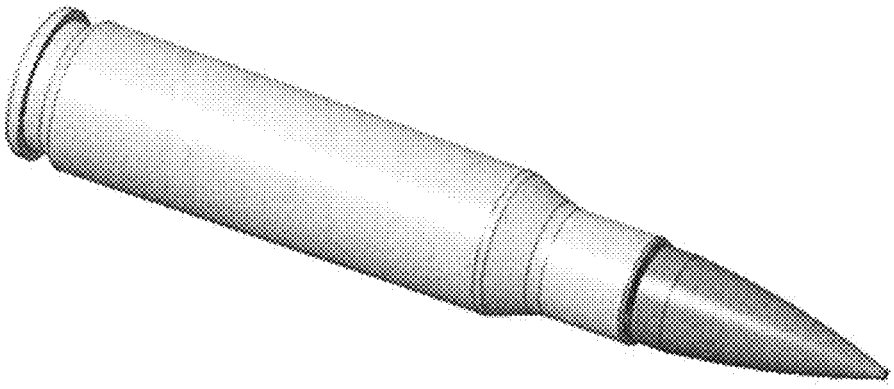
FIG. 1 (Prior Art)
FIG. 1 is an isometric perspective view of a conventional cartridge.
Figure 2:
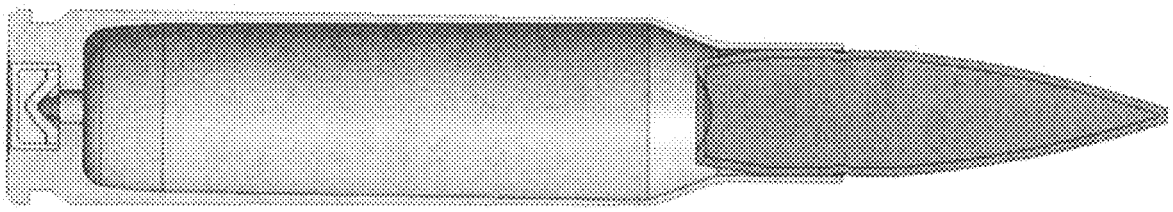
FIG. 2 (Prior Art)
FIG. 2 is a cross-sectional view of a conventional cartridge.

A cartridge case with a case crush region facilitates an additional amount of case crush in the axial direction, per unit of input force and energy, as compared to an identical cartridge case without such a region. The crush region can be either of a fully or partially circumferential nature with applicability to any style cartridge case, be it bottleneck or straight-walled and of any rim configuration (rimmed, semi-rimmed, rimless, rebated-rim, belted) and without prejudice to the case material (brass, stainless steel, polymer, etc.). This feature may be incorporated into the design of existing cartridge cases as well as future designs.

The compressible cartridge case is described throughout as an improvement benefiting small caliber ammunition. In that regard, it is applicable to both bottleneck and straight-walled cases of any rim configuration (rimmed, semi-rimmed, rimless, rebated-rim, belted) or case material (metallic, polymer, hybrid, etc.). However, it is not limited to small caliber ammunition. It may also be applicable and beneficial to certain medium or even large caliber applications.

The advantages of a cartridge case with a case crush region are significant and include improved firing accuracy and precision, increased life of firearm components that structurally support the forces generated during cartridge firing, and ability to safely increase chamber headspace tolerances thereby reducing manufacturing and/or assembly costs of firearm components that contribute to chamber headspace control.

The compressible cartridge case may be exploited for a specific set of performance advantages depending on the class of firearms and functional priorities. Effectively, the increased level of case crush may be used to either reduce or eliminate clearance between bolt face and cartridge case head under all material tolerance conditions, add to the allowable chamber headspace tolerance band, or a combination of the two.

For applications that prioritize maximum firing accuracy and precision (sniper rifles, for example), the additional achievable amount of case crush would be applied to reduce or eliminate the axial clearance that would otherwise exist between bolt face and chambered cartridge case head. This would facilitate, while firing production ammunition assembled with new cases, the firing accuracy and precision gains that are typically associated with using reloaded ammunition assembled with fire formed cases. As an ancillary benefit, eliminating the clearance between bolt face and chambered cartridge case head would also enable an increase in bolt life as the geometric conditions that allow for impact loading during the firing event are eliminated.

For applications entertaining higher operating pressure cartridges that place increased structural demands on the bolt locking features, the additional achievable amount of case crush would also likely be applied to reduce or eliminate the axial clearance that would otherwise exist between Bolt face and chambered cartridge case head as this would prevent impact loading during the firing event and subsequently reduce the defined safe working load governing the Bolt locking lug design by an appreciable amount. The firing accuracy and precision gains would also be realized.

For applications that typically utilize conventional cartridges operating at conventional peak chamber pressures and wish to increase component life of the firearm bolt, once again the additional achievable amount of case crush of the compressible case would be applied to reduce or eliminate the axial clearance that would otherwise exist between bolt face and chambered cartridge case head as this would prevent impact loading during the firing event and reduce the shot-to-shot structural demands placed on the bolt. Component survivability and fatigue life would be improved. The firing accuracy and precision gains would also be realized.

For applications that typically utilize conventional cartridges operating at conventional peak chamber pressures and aren't overly concerned with improving current firing accuracy or precision (machine guns, for example), to reduce weapon component and assembly fabrication costs the compressible cartridge case may be implemented while still allowing for comparable levels of clearance between the bolt face and chambered cartridge case head. Taking this approach in combination with use of the compressible cartridge would allow a reduction in the minimum chamber headspace dimension, which would increase the overall allowable tolerance of chamber headspace. This leads to increased component level and assembly tolerances for the firearms parts that contribute to headspace control. Larger tolerances lead to a reduction in fabrication costs and scrap rate.

While these previously described scenarios are merely examples of how the additional case crush may be leveraged to exploit specific advantages, the performance gains are substantial. Use of the compressible cartridge case enables a higher amount of case crush to take place per given unit of input force and energy. This increased case crush may then be exploited to improve firing accuracy and precision, increase the life of firearm components that structurally support the forces generated during cartridge firing, and increase chamber headspace tolerances thereby reducing manufacturing and/or assembly costs of firearm parts that contribute to chamber headspace control.

Figure 3:
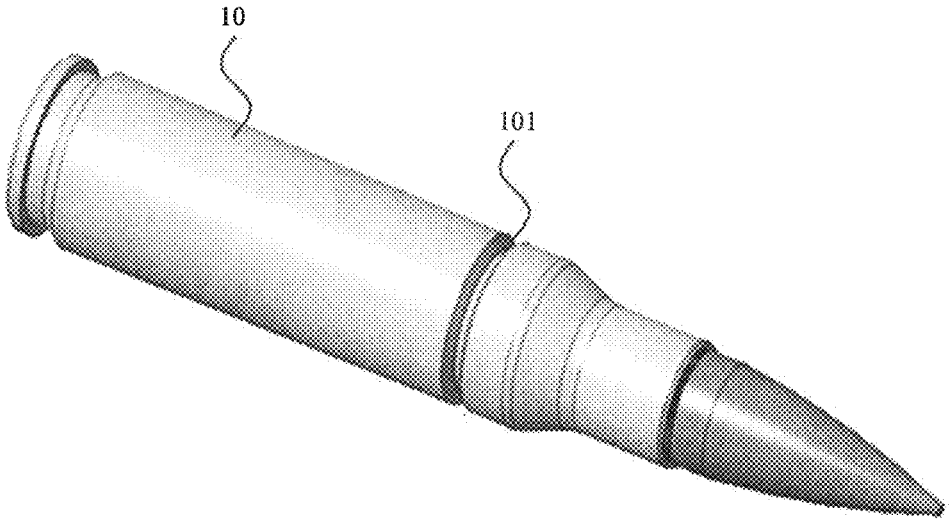
FIG. 3 is an isometric perspective view of cartridge with a cartridge crush region, in accordance with one illustrative embodiment.
Figure 4:
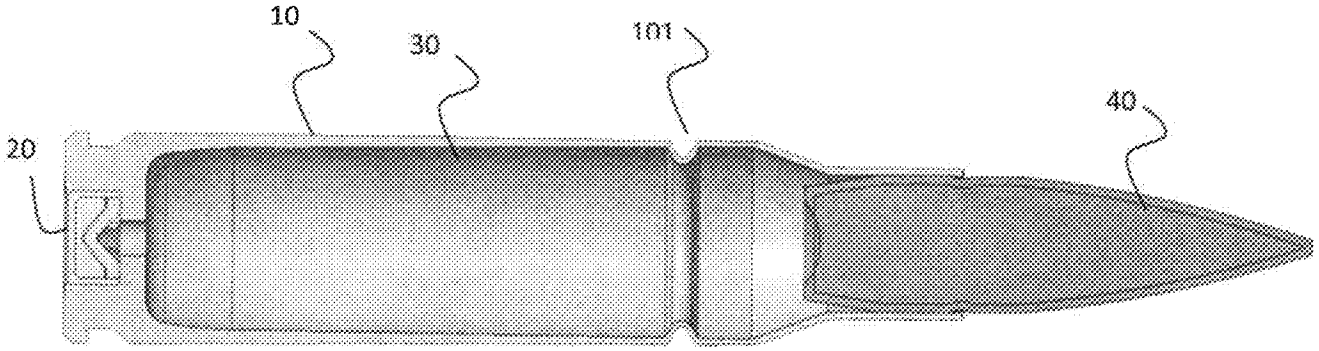
FIG. 4 is a cross-sectional view of a cartridge with a cartridge crush region, in accordance with one illustrative embodiment.

FIG. 3 is an isometric perspective view of cartridge with a cartridge crush region, in accordance with one illustrative embodiment. FIG. 4 is a cross-sectional view of a cartridge with a cartridge crush region, in accordance with one illustrative embodiment. The cartridge comprises a cartridge case 10, primer 20, interior volume 30 for propellant and projectile 40. The cartridge case 10 further comprises a case crush region 101 for facilitating an additional amount of case crush in the axial direction. The case crush region 101 is a circumferential groove defined by the cartridge case 10. While the case crush region 101 shown in FIG. 3 and FIG. 4 has an angled v-notch profile with root radius, the case crush region 101 is not limited to a groove of that particular profile. Other embodiments may comprise grooves having alternative v-notch, semi-circular or full radius, square or rectangular profiles with or without partial or full root radius elements. Other embodiments of a partially circumferential nature or those with discretely applied and multiple crush regions placed in succession about the circumference may be comprised of indentations/dimples of partial or fully angular or spherical profiles, for example.

In a conventional cartridge case of typical sidewall geometry, the input force, such as a chambering input force, and energy required to induce axial crush is applied in a manner that relies almost entirely on compressive stress through a segment of the overall cartridge case length. With the case crush region, be it a v-notch, radius, square or rectangular groove, etc., the input force and energy applied not only induces compressive stress but also a bending stress component at the root of the feature. The achievable crush per unit of input force and energy is then amplified by the combination of compressive and bending induced contributions to the overall axial deformation.

Controlling the depth of the v-notch or groove and/or sectional wall thickness of the feature allows for manipulation of the additional amount of achievable crush. For example, a deeper groove offers a longer moment arm and greater deflection/deformation via the induced bending stress per unit input force and energy. Likewise, a groove of thinner sectional wall thickness would also facilitate greater defection/deformation per unit force and energy. In practice, the extent to which the v-notch or groove may be modified would be subject to the structural requirements of the given cartridge during firing and extraction as well as the internal case volume requirements for the propellant charge.

When incorporating the case crush region into existing cartridge case designs, a preferred approach would be to identify the currently allowable case crush for a particular caliber and conventional case geometry and then calculate the force and energy requirements to achieve that level of crush. The force and energy associated with that would then become the input values into the engineering analyses done to define an optimal case crush region in terms of both geometry and location so as to achieve the desired level of increased case crush. The intent would be to not impose any additional input force or energy demands over what is typically required for the situation where unmodified cases were used. In this way, use of the cartridges assembled with the new compressible cartridge cases would be imperceptible to the operator (in the case of manually operated firearms) or the operating group (in the case of self-powered, auto cycling firearms) as no additional force or energy would be required to achieve bolt lock despite the fact that achievable levels of case crush are increased.

There are several additional design considerations that should be included in a preferred approach for implementing the case crush region. First, it is desirable to maintain elastic material response throughout the overall range of allowable case crush. This is significant from a safety perspective should a cartridge comprised of a case with a crush region ever be chambered into a particular firearm, removed without firing, and then chambered and fired in a different firearm with a different chamber headspace dimension. Second, it is desirable to incorporate the minimum size crush region necessary, to achieve the desired increase in axial crush, in order to minimize the reduction in internal volume of the cartridge case that would otherwise be available for propellant. This is a more relevant consideration for existing cartridges that may want to implement cases with a crush region and especially for cartridge configurations that include a compressed propellant charge. Third, tooling and manufacturing production processes should be consulted when defining the crush region, as achievable geometries such as those at the root of the feature may impact the resultant stresses during cartridge chambering and ultimately the increased level of axial case crush. Lastly, the structural integrity of the designed crush region should be carefully considered as to not impose any problems in case extraction, post firing, from the cartridge chamber.

Taking advantage of the ability to increase case crush could be done in several ways. If the current maximum case length for a particular caliber (as defined for the conventional case geometry) were retained for the compressible cartridge case configuration, the chamber headspace in the firearm could be reduced proportionally to the increased amount of achievable case crush. If the maximum chamber headspace on the gun side were retained, the maximum length of the compressible cartridge case could be increased proportionally to the increased amount of achievable case crush. In practice, at first glance it would seem prudent to increase the maximum length of the compressible case for any previously developed cartridges in use (that would now have the crush region feature) as this would allow for immediate use in existing firearms without any change to the firearm. Additionally, this approach would allow for cartridges of both the old conventional and new compressible configurations to be used interchangeably in the same firearm. For developmental or future firearms and ammunition, it's an easier integration decision as the firearm and chamber headspace would be designed around the defined limits of the compressible cartridge, as this would be the only envisioned cartridge style used.

Much like conventional case designs that are caliber specific, the compressible cartridge case crush region feature may be caliber specific in terms of the exact profile, size, and location of the case crush region.

Advantageously, should a compressible cartridge be chambered and then removed without firing, there is nothing prohibitive from a functional or safety perspective in rechambering and firing the cartridge. After firing a cartridge assembled with the new compressible case, the pressures generated by firing will elastically deform the v-notch or groove of the crush region toward the chamber wall. Visually there may be no or very little indication, post firing, that the crush region ever existed.

Advantageously, in regard to manufacturing and producibility, the v-notch or groove of the compressible cartridge case crush region is an easily applied feature whether incorporating into production lines of current cartridge cases or incorporating into the planned future production of developmental cartridge designs. For conventionally formed metallic cartridge cases, this feature may be added, for example, by way of an automated turning operation with the contact tip geometry of the forming tool being equal to the defined geometry of the v-notch or groove feature of the crush region. With the case adequately supported, pressure would be applied to the forming tool, and either the case or the tool could be rotated, relatively speaking to one another, in order to generate a circumferential crush region. For metallic cartridge cases manufactured using metal injection molding, the feature could be incorporated directly into the mold. For any polymer/plastic or hybrid polymer-metallic case, the feature could be incorporated directly into the mold of the polymer case portion.

Figure 5:
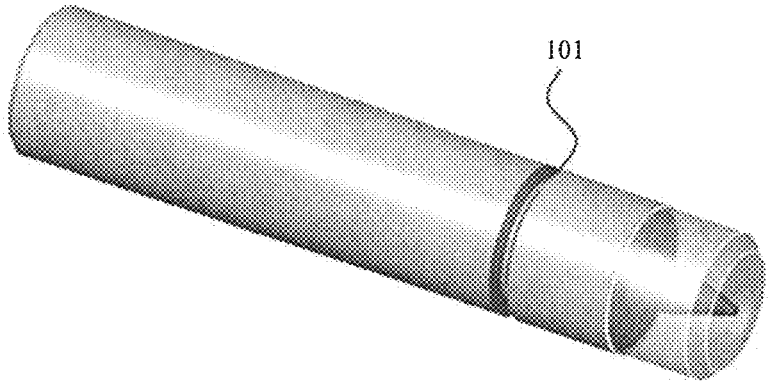
FIG. 5 is an isometric perspective view of a case telescoped cartridge with a cartridge crush region, in accordance with one illustrative embodiment.

FIG. 5 is an isometric perspective view of a case telescoped ammunition round with a cartridge crush region, in accordance with one illustrative embodiment. While throughout this specification, the cartridge crush region is described as being implemented on a bottleneck configuration of a cartridge case, it is not limited to bottleneck cartridge cases. The case crush region may be applied to any ammunition comprising a case. For example, a cylindrical or straight-walled or tapered cartridge case may comprise a case crush region. In one embodiment, the cartridge case crush region is implemented on a case telescoped ammunition round.

While the invention has been described with reference to certain embodiments, numerous changes, alterations and modifications to the described embodiments are possible without departing from the spirit and scope of the invention as defined in the appended claims, and equivalents thereof.

What is claimed is:

1. A cartridge case for facilitating an additional amount of case crush in an axial direction, the cartridge case comprising a body having a groove defined by an outer surface of the body and configured for compressing in the axial direction in response to a chambering force at a ratio greater than that of a remaining region of the cartridge case wherein the groove is located on the body not proximate to a projectile seated within the cartridge case.

2. The cartridge case of claim 1 wherein the groove has a v-shaped cross sectional profile.

3. The cartridge case of claim 1 wherein the groove has a semi-circular cross sectional profile.

4. The cartridge case of claim 1 wherein the groove has a rectangular cross sectional profile.

5. The cartridge case of claim 1 wherein the groove extends around the entire circumference of the body.

6. The cartridge case of claim 1 wherein the groove extends partially around the circumference of the body.

7. The cartridge case of claim 1 further comprising a plurality of grooves defined by the outer surface of the body.

8. The cartridge case of claim 1 wherein a thickness of the geometric feature is lesser than a thickness of the body proximate to the crush region.

9. The cartridge case of claim 1 wherein the cartridge case is a bottleneck cartridge case.

10. The cartridge case of claim 1 wherein the cartridge case is a case telescoped cartridge case.

11. The cartridge case of claim 1 wherein the cartridge case is a straight walled case.

12. The cartridge case of claim 1 wherein the cartridge case is a tapered walled case.

13. A bottleneck cartridge case for facilitating an additional amount of case crush in an axial direction, the cartridge case comprising a body having a crush region configured for compressing in the axial direction in response to a chambering three at a ratio greater than that of a remaining region of the cartridge case wherein the crush region further comprises a groove defined by the body of the cartridge case and having a v-shaped cross sectional profile, the groove extended circumferentially around the body and located on the body a distance from a projectile seated within the cartridge case.

* * * * *